United States Patent [19]

Masuda

[11] Patent Number: 4,535,611

[45] Date of Patent: Aug. 20, 1985

[54] TREATING TEXTILE MATERIAL WITH NON WOVEN FABRIC ROLLS

[75] Inventor: Masao Masuda, Toyoake, Japan

[73] Assignee: Kabushiki Kaisha Masuda Seisakusho, Aichi, Japan

[21] Appl. No.: 532,566

[22] Filed: Sep. 15, 1983

[30] Foreign Application Priority Data

Sep. 17, 1982 [JP] Japan ..... 57-162697
Jan. 17, 1983 [JP] Japan ..... 58-6184

[51] Int. Cl.[3] ..... D06B 1/16

[52] U.S. Cl. ..... 68/202; 118/50; 118/259

[58] Field of Search ..... 68/198, 189, 202, 203, 68/228, 244, 212, 213, 43, 46; 101/172, 367, 119, 120; 401/197; 8/151; 118/259, 50, DIG. 15

[56] References Cited

U.S. PATENT DOCUMENTS

| | | | |
|---|---|---|---|
| 1,769,980 | 7/1930 | Allen | 401/197 |
| 3,408,984 | 11/1968 | Pullins | 101/119 |
| 3,650,675 | 3/1972 | Meyer et al. | 68/203 X |
| 3,812,782 | 5/1974 | Funahashi | 401/197 X |
| 3,862,617 | 1/1975 | Prestegaard | 101/367 X |
| 4,302,122 | 11/1981 | Moya | 401/197 X |

FOREIGN PATENT DOCUMENTS 554330 6/1977 U.S.S.R. ..... 68/202

*Primary Examiner*—Philip R. Coe
*Assistant Examiner*—Frankie L. Stinson
*Attorney, Agent, or Firm*—Birch, Stewart, Kolasch & Birch

[57] ABSTRACT

A method for treating textile material comprising steps of forcibly supplying treatment fluid into a fluid supply roll and letting the supplied fluid flow out of its circumferential periphery, applying negative pressure to a suction roll, passing a textile material between the fluid supply and the suction rolls which are arranged in opposed relationship, and forcibly transferring the fluid on the fluid supply roll into the suction roll through an interfacing portion of the textile material; each of the fluid supply roll and the suction roll for use in carrying out the method comprising a number of nonwoven fabric elements mounted on a cylindrical core in tightly contact relation to one another, and fluid passageways formed internally thereof so as to be operatively connected to an external pressure fluid source or an external negative pressure source.

10 Claims, 26 Drawing Figures

TREATING TEXTILE MATERIAL WITH NON WOVEN FABRIC ROLLS

BACKGROUND AND SUMMARY OF THE INVENTION

This invention relates to treatment of textile material, and more particularly to a method for treating textile material and also to nonwoven fabric rolls for use in carrying out the method.

As is well known in the field of the invention, textile material such as woven cloth, nonwoven fabric, knitted fabric and other textile fabric, is often subjected sequentially or independently to one or more treatment stages such as for example dipping, washing, rinsing, neutralizing, and various other chemical treatments. Most of these treatments have conventionally been conducted by passing the material through treating liquid or water filled in a bath or reservoir. Regardless of a scale of treatment, a solution bath or bathes have been inevitably required for carrying out the conventional treating methods, even in such a particular case where a very simple or partial treatment is satisfactory. Accordingly, the conventional methods are disadvantageous from the viewpoint of energy-saving, rationalization of the treatment system and achivement of low bath ratio for saving treatment medium.

In the treatment of textile material, a dewatering process is accompanied everywhere. For instance a water-washing system, a bleaching system, a dyeing system and other chemical treatment systems for textile material all usually include as many as two to four dewatering equipments, and the textile material undergoes such dewatering many times. Further, in some particular cases, wiping rolls, doctor blades, and other extra equipments are employed in order to assist the dewatering.

It is, therefore, considered that enhancement of efficiency in dewatering or removal of treating liquid from textile material under treatment will greatly contribute to the above-discussed energy saving, rationalization of the treatment system and achievement of low bath ratio.

Under these technical circumstances and background, nonwoven fabric rolls including a number of liquid-absorbing nonwoven fabric disks pressed together into tight contact relation, have been proposed and are now widely used in place of the conventional rubber rolls.

However, such conventional nonwoven fabric rolls are only to utilize the water-absorbing property of the nonwoven fabric, which no longer works when entirely saturated with absorbed water or liquid. For recovering the water-absorbing property of the nonwoven fabric roll, an expensive extra equipment is inevitably required.

It is, therefore an object of the invention to substantially reduce the above-discussed disadvantages in the conventional treatment of textile material.

Another object of the invention is to provide an improved method for treating textile material, which is simple to carry out, efficient, economical, capable of saving energy and treatment medium, and applicable to variou systems and stages for treating textile material.

A further object of the invention is to provide an improved method for treating textile material, which permits partial treatment of textile material, rationalization of the treating system and process, and low bath ratio.

A further object of the invention is to provide an improved method for treating textile material, which is capable of efficient dewatering, which in turn permits reduction in operating time and heat energy required in a subsequent drying stage.

A further object of the invention is to provide an improved method for treating textile material, which permits easy control of flow rate of applied treatment medium or water whereby uniform quality of treated material is attained.

A further object of the invention is to provide an improved nonwoven fabric roll for use in carrying out the textile treating method according to the invention.

A further object of the invention is to provide an improved nonwoven fabric roll having internal fluid passageways which can be operatively connected to an external fluid supply system or apparatus or an external suction system or apparatus.

A further object of the invention is to provide an improved nonwoven fabric roll which is capable of letting the supplied treatment medium or water flow out of its circumferential periphery.

A yet further object of the invention is to provide an improved nonwoven fabric roll which is capable of sucking off the treatment medium or water applied to and contained in the textile material.

According to the present invention, there is provided a method for treating textile material, which comprises: forcibly supplying treating fluid into a fluid supply roll through internal fluid passageways formed therein and letting the supplied fluid flow out of the circumferential periphery of the supply roll, applying negative pressure to a suction roll through fluid passageways formed therein, passing a textile material between the opposed fluid supply and the suction rolls, and forcibly transferring the fluid on the supply roll into the suction roll through an interfacing portion of the textile material by sucking operation of the suction roll. Combination and arrangement of the fluid supply roll or rolls and the suction roll or rolls can be varied in many ways.

According to the present invention, there is also provided a nonwoven fabric roll for use in carrying out the aforesaid method for treating textile material, which comprises: a number of nonwoven fabric elements mounted on a cylindrical core in tight contact relation to one another, and fluid passageways formed internally of the roll so as to be operatively connected to an external pressure fluid source or an external negative pressure source. The fluid passageways can be provided in various forms.

Other objects, features and advantages of the invention will become apparent from the detailed description give hereinafter: it should be understood, however, that the detailed description and specific examples, while indicating preferred embodiments of the invention, are given by way of illustration only, since various changes and modifications within the spirit and scope of the invention will become obvious to those skilled in the art from this detailed description.

DESCRIPTION OF THE PREFERRED EMBODIMENTS

Figure 1:
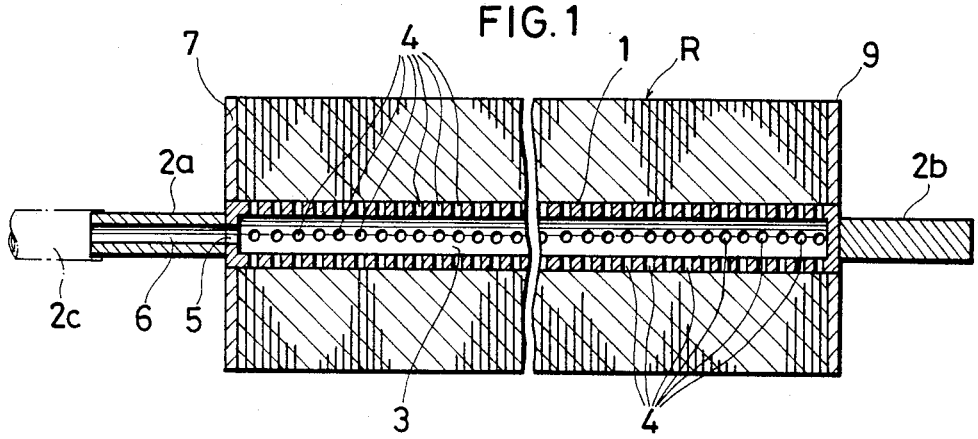
FIG. 1 is a longitudinal section, with parts broken away, of a nonwoven fabric roll according to the invention.

Referring now to the accompanying drawings, in particular to FIGS. 1 to 15 first, wherein identical reference numerals are used throughout the various views to indicate corresponding or substantially identical parts or elements, there are illustrated various forms of nonwoven fabric rolls R for use in carrying out the treatment method according to the present invention.

FIG. 1 illustrates the simplest form of the roll R showing the basic idea of the present invention, wherein the roll R includes a cylindrical core 1 having ends connected to or formed integral with coaxial journal members or shafts 2*a*, 2*b* which are rotatably supported by bearings (not shown), conventionally. The core 1 may be a metallic tube having an internal cylindrical hollow space 3 for passage of fluid. A number of perforated holes 4 for the inlet and outlet of fluid are formed in the cylindrical wall of the core 1. The holes 4 are distributed over length of the core 1 and each of them is communicated with the axial hollow space 3. The hollow core 1 is closed at its one end and open at its other end 5 to an internal axial through bore 6 of the shaft 2*a*. Thus, the axial bore 6, the opening 5 and the axial hollow space 3 are intercommunicated to form a fluid passageway which is operatively connected via a conduit 2*c* to a suitable known fluid supply system or a suitable known suction system (not shown).

A pair of spaced disk-shaped rigid end plates 7, 9 are mounted on the core 1, and a desired number of nonwoven fabric elements 8, each being in the form of a disk with a central hole 8*a* (FIG. 12), are mounted on the core 1 so as to be sandwiched between the end plates 7, 9 and pressed together into tight contact to one another, conventionally. Each of the nonwoven fabric elements 8 can absorb and contain a certain amount of liquid therein.

Figure 2:
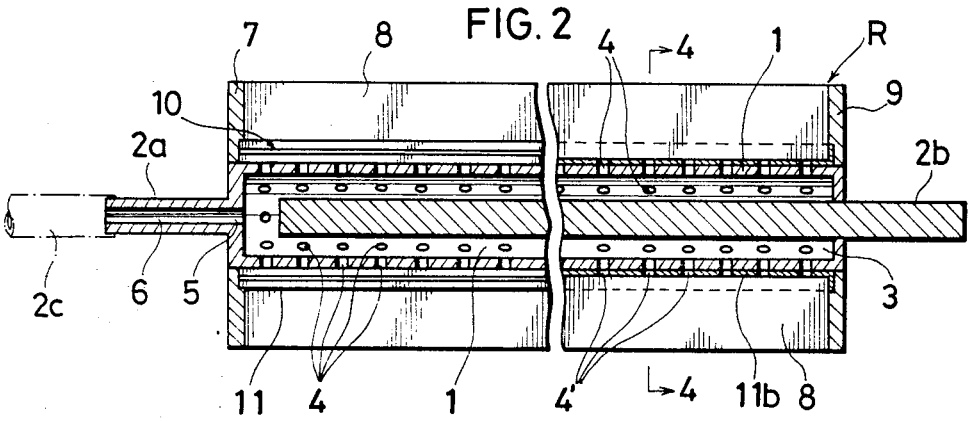
FIG. 2 is a similar view to FIG. 1, but showing another embodiment of the invention.
Figure 3:
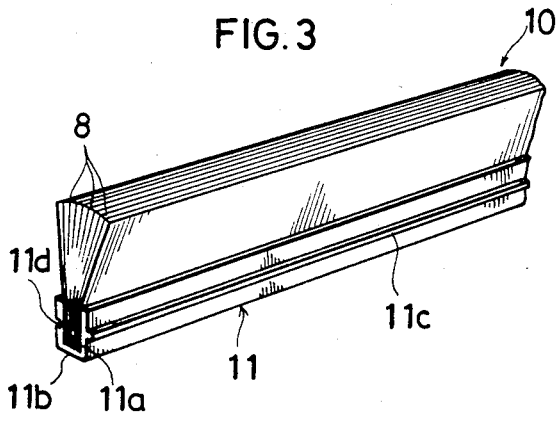
FIG. 3 is a perspective view of a nonwoven fabric unit to be incorporated with the roll of FIG. 2.
Figure 4:
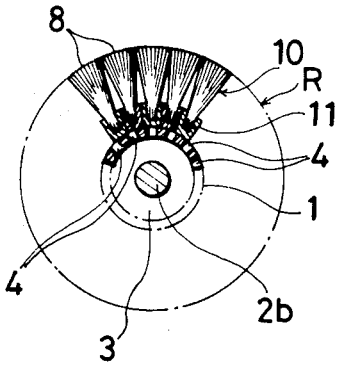
FIG. 4 is a partial cross-section along lines 4—4 of FIG. 2.

FIGS. 2 to 4 illustrate another embodiment of the invention, wherein each of the nonwoven fabric elements 8 is in the form of a rectangular sheet. A predetermined number of the rectangular sheet elements 8 are fitted into a longitudinal groove 11*a* of an elongated mounting base 11 which is U-shaped in cross section and has a series of perfarated holes 4' formed in its bottom wall 11*b* in such a manner that the holes 4' are opposed to the holes 4 of the core 1 so as to be communicated therewith for the inlet and outlet of fluid, as clearly shown in FIG. 2. The mounting base 11 and the nonwoven fabric elements 8 fixed thereto constitute a unit 10 and a predetermined number of such units 10 are mounted on the core 1 in side-by-side relation to cover the entire circumference of the core, with each of the nonwoven fabric elements 8 radially extended as best shown in FIG. 4. The units 10 are interposed between the pair of end plates 7, 9 and held in position by means of the end plates 7, 9 and/or suitable known clamping bands (not shown).

Preferably, each of the mounting bases 11 may be formed on its one side wall with a male member 11*c* and in its other side wall with a female member or groove 11*d* engageable with the male member 11*c* for easy positioning with respect to the adjacent base when the units 10 are mounted on the core 1. The shaft 2*b* may be extended into the hollow core 1 as illustrated in FIG. 2, if desired.

Figure 5:
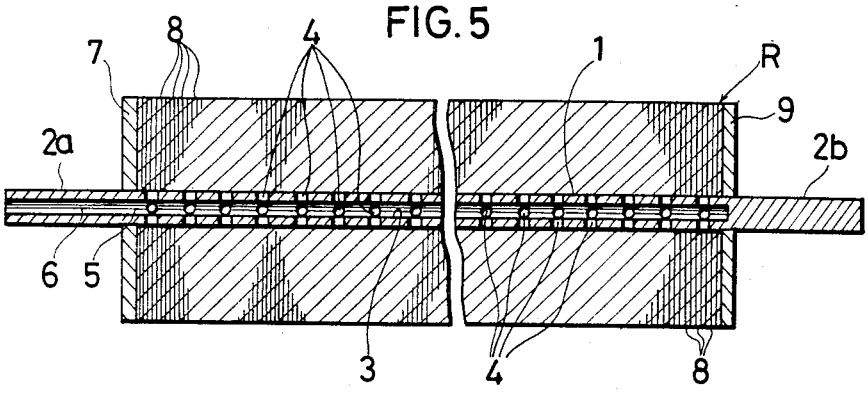
FIG. 5 is also a similar view to FIG. 1, but showing a further embodiment of the invention.
Figure 5A:
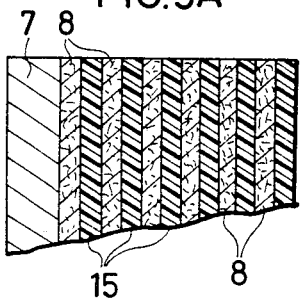
FIGS. 5A and 5B are enlarged, fragmentary sections showing examples of nonwoven fabric disk arrangement.
Figure 5B:
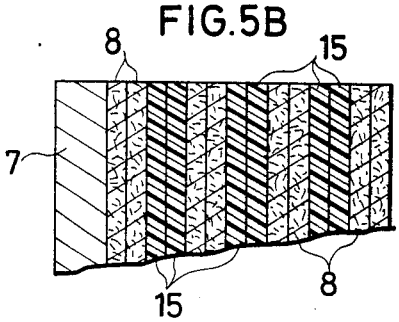
Figure 6:
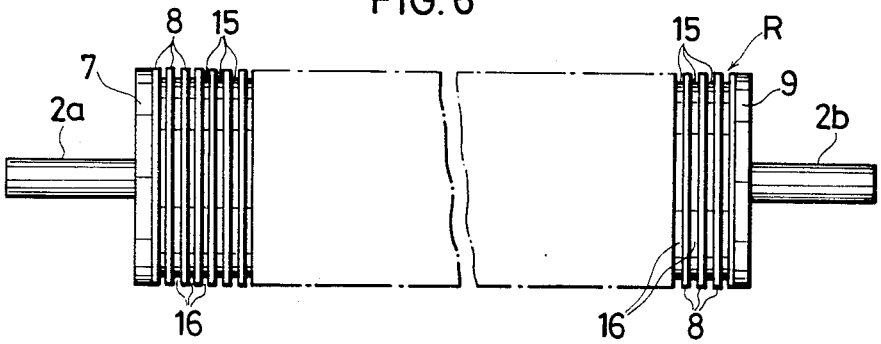
FIG. 6 is a front elevation showing a further modification of the nonwoven fabric roll of the invention.
Figure 6A:
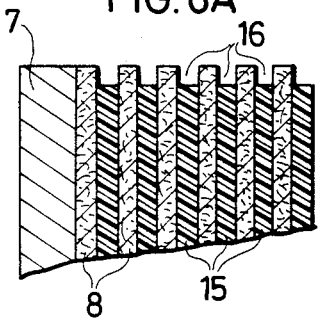
FIGS. 6A and 6B are similar views to FIGS. 5A and 5B, but showing further examples of nonwoven fabric disk arrangement.
Figure 6B:
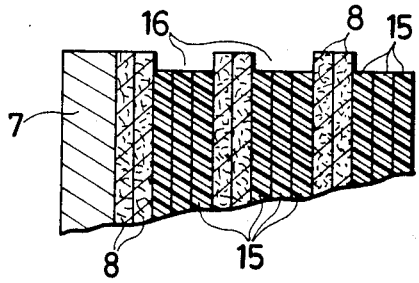

FIGS. 5 to 6B illustrate modified arrangements of the nonwoven fabric elements 8, wherein one or more foreign elements 15 are sandwiched between a pair of adjacent nonwoven fabric elements 8 of liquid-absorbing character. On the other hand, each of the foreign elements 15 is made of non-liquid absorbing sheet material such as rubber, polyester, ceramics, or the like, in order to substantially reduce the absorbedback amount of liquid which was just removed from the roll R but tends to be adsorbed back into the roll R.

In this connection, it will be apparent that the nonwoven fabric elements 8 and the foreign elements 15 may be arranged on the core 1 in various combinations in addition to the illustrated examples.

Further, an external diameter of the elements 8 may be different from that of the elements 15, so that a plurality of annular grooves 16 or channel for liquid flow are formed in the circumferential periphery of the roll. The grooves 16 extend in spaced and parallel relationship to one another and transversely to the axis of the roll R. The grooved roll R is especially advantageous when it is used in combination with a nonliquid-absorbing roll, for example a rubber roll (not shown), because the liquid removed from the roll R can flow along the grooves 16.

The number of the grooves 16 and a cross sectional area of each of the grooves can be varied in many ways merely by selecting a diametrical difference between the elements 8 and 15 as well as a combination in number of the elements 8 and the elements 15 as illustrated by way of example in FIGS. 6A and 6B. In these Figures, the elements 8 are illustrated as being greater in diameter than the elements 15. However, the elements 8 may be smaller in diameter than the elements 15.

Figure 7:
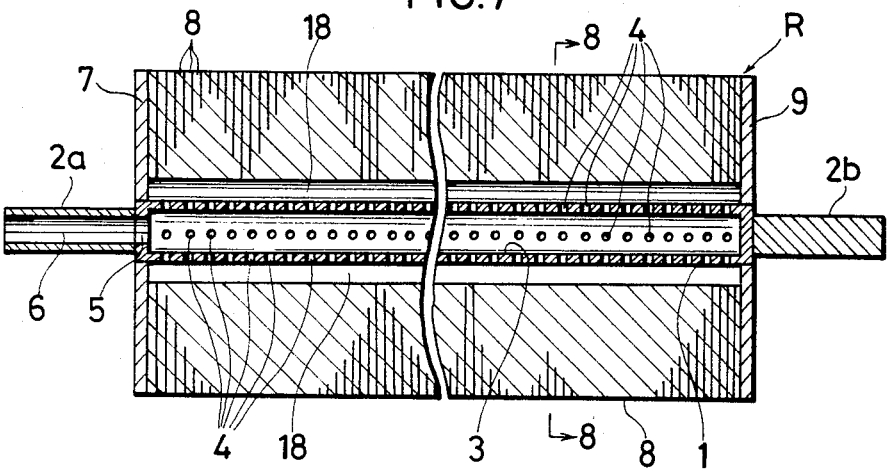
FIG. 7 is also a similar view to FIG. 1, but showing a modification of the roll as illustrated in FIG. 1.
Figure 8:
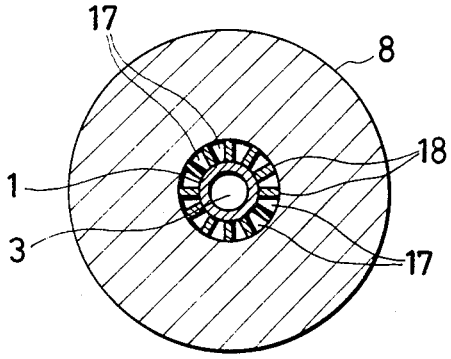
FIG. 8 is a cross section taken along the lines 8—8 of FIG. 7.
Figure 9:
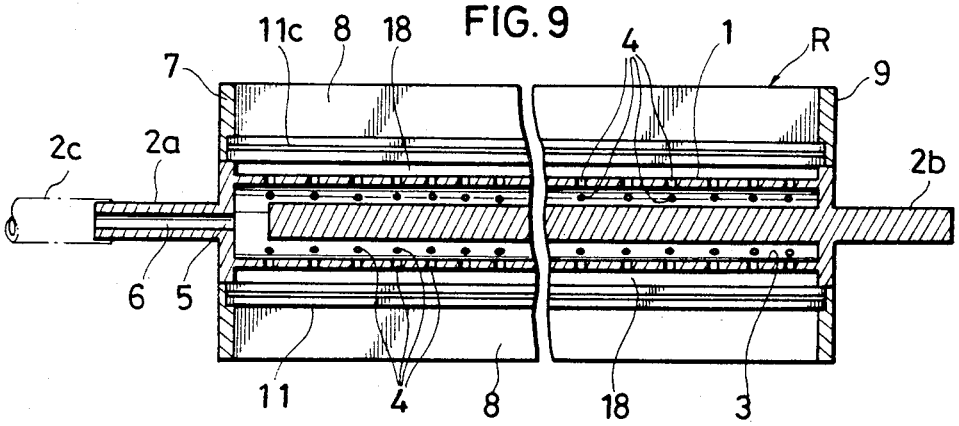
FIG. 9 is also a similar view to FIG. 1, but showing a modification of the roll as illustrated in FIG. 2.
Figure 10:
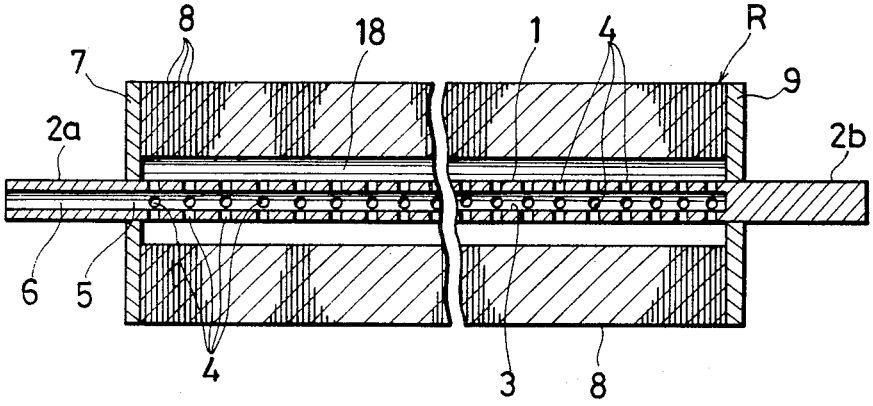
FIG. 10 is also a similar view to FIG. 1, but showing a modification of the roll as illustrated in FIG. 5.

FIGS. 7 to 10 illustrate modifications of the rolls R shown and described in connection with the preceding Figures, wherein a plural number of elongated spacers 18 are interposed between the core 1 and the nonwoven fabric elements 8 to provide the same number of axially extending channel-shaped spaces 17 which serve as passageways and/or reservoirs for treatment liquid. More particularly, FIGS. 7 and 8 illustrate the modification of the roll R shown in FIG. 1; FIG. 9 illustrates the modification of the roll R shown in FIGS. 2 to 4; and FIG. 10 illustrates the modification of the rolls R shown and described in connection with FIGS. 5 to 6B. These embodiments illustrated here in FIGS. 7 to 10 are advantageous in enhancement of the forced flowing-out and/or sucking-in effect to the fluid applied.

Figure 11:
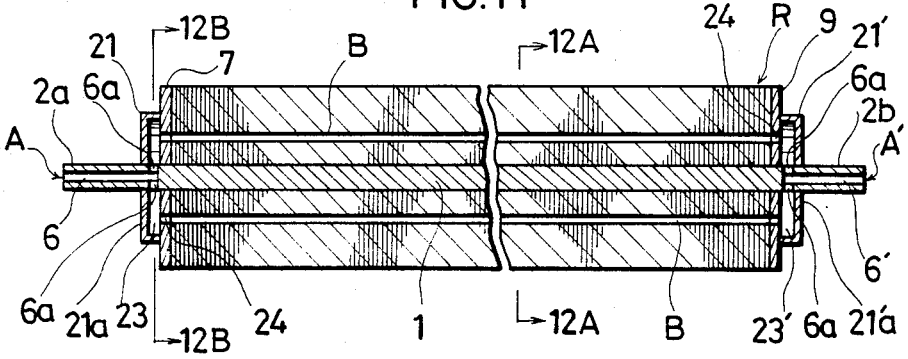
FIG. 11 is also a similar view to FIG. 1, but showing a still further embodiment of the invention.
Figure 12A:
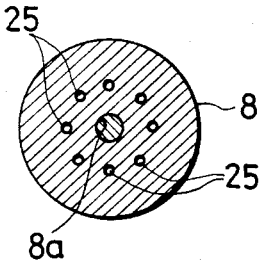
FIG. 12A is a cross section taken along the line 12A—12A of FIG. 11.
Figure 12B:
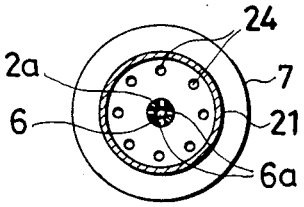
FIG. 12B is a cross section taken along the lines 12B—12B of FIG. 11.

FIGS. 11, 12A and 12B illustrate a further embodiment of the invention, advantageous for large-sized rolls R, wherein the core 1 is not hollow but solid, and each of the disk-shaped nonwoven fabric elements 8 has a plurality of circumferentially spaced apertures 25 formed therein at predetermined locations as will be hereinafter described more in detail. If desired, the shaft 2*b* may be formed with an internal axial through bore 6′ which is similar to the bore 6 of the other shaft 2*a*, as illustrated in FIG. 11. Each of the inner ends of the shafts 2*a*, 2*b* is formed with two or more radially extending ports 6*a* for the inlet and/or outlet of fluid.

A short cylindrical member 21, whose outer end is closed by an end wall 21*a*, is mounted on the inner end of the shaft 2*a* in substantially hermetical manner with respect to the shaft 2*a* and the outer wall surface of the end plate 7, so that an internal annular hollow space 23 is formed between the end plate 7 and the end wall 21*a*. The hollow space 23 are so formed as to be communicated with each of the radial ports 6*a* of the shaft 6. In the embodiment as illustrated in FIGS. 11, 12A and 12B, a further short cylindrical member 21′, similar to the aforesaid cylindrical member 21, is mounted on the shaft 2*b* in substantially the same manner as described, to form an internal annular hollow space 23′, similar to the space 23, between end wall 21*a*′ and the end plate 9. The hollow space 23′ is so formed as to be communicated with the radial ports 6*a* of the shaft 2*b*.

Thus, a fluid passageway A, which consists of the axial bore 6, the radial ports 6*a*, and the annular hollow space 23, is formed at one side of the roll R, while a similar fluid passageway A′ consisting of the axial bore 6′, the radial ports 6*a* and the annular hollow space 23′ is formed at the other side of the roll R.

Each of the end plates 7, 9 has a plurality of circumferentially spaced apertures 24 formed therein so as to be communicated with the aforesaid internal annular hollow space 23 or 23′. The circumferentially spaced apertures 25 formed in each of the nonwoven fabric elements 8 are so located as to be opposed to the apertures 24 of the end plates 7, 9, for intercommunication, resulting in that the apertures 24 and 25 constitute a plurality of axially extending fluid passageways B when the elements 8 are mounted on the core 1 and disposed between the pair of end plates 7, 9 in tightly contact relation to one another.

Since the passageway A, A′ and the passageways B are interconnected with each other via the apertures 24, the fluid applied can flow through the passageways A, B, A′, which can be operatively connected, for example via a known rotary joint (not shown), to an external force liquid supply system or an external suction system (known and not shown).

Figure 13:
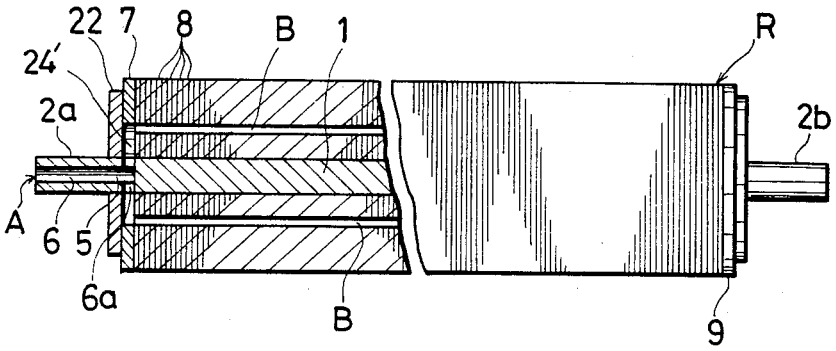
FIGS. 13 and 14 are partially sectional front elevations, with parts broken away, of further embodiments of the invention.

FIG. 13 illustrates a modification of the roll R as shown and described in connection with FIGS, 11, 12A and 12B, wherein an annular internal hollow space 24′ is formed in the end plate 7, so as to be communicated with the passageways B and also with the passageway A via the radial ports 6*a*. The space 24′ is appropriately covered by a cover plate 22. If desired, the same construction may be provided at the opposite side where the shaft 2*b* is provided.

Figure 14:
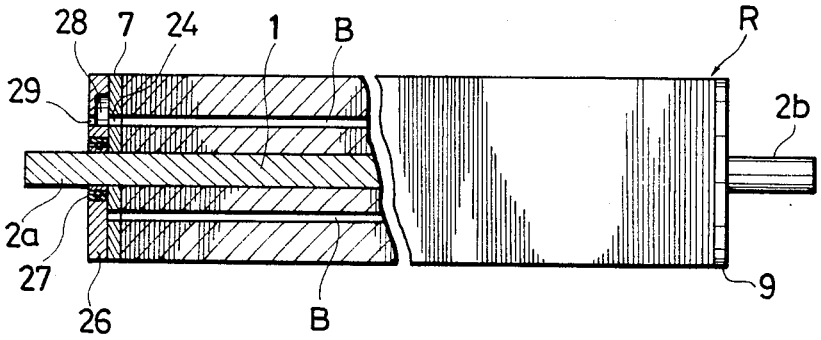
Figure 15:
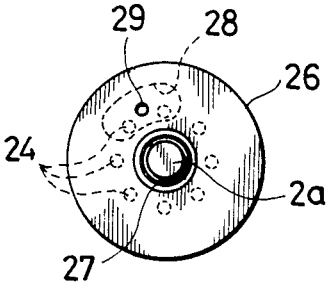
FIG. 15 is a lefthand side elevation of FIG. 14.

FIGS. 14 and 15 illustrate a further embodiment of the invention, especially advantageous for large and heavy rolls R, where the shafts 2*a*, 2*b* and the core 1 are integrally formed into a single solid shaft so that it can support heavy load, and a stationary disk 26 is supported via a known bearing member 27 on the core 1 so as to be free from rotation of the roll R, in relatively slidable relation to the outer wall surface of the end plate 7.

The stationary disk 26 has a recess 28 formed in its inward wall, which is communicated with two or more of the axial fluid passageways B via the apertures 24 of the end plate 7. The recess 28 is operatively connected to an external pressure fluid source or an external negative pressure source via a known conduit (not shown) and a port 29 which is formed in the wall of the end plate 7 so as to be communicated with the recess 28. Thus, as the roll R rotates, two or more of the apertures 24 come into and then out of communication with the recess 28 one after another in an endless manner. Incidentally, a suitable known sealing member (not shown) may preferably be interposed between the end plate 7 and the stationary disk 26.

Figure 16:
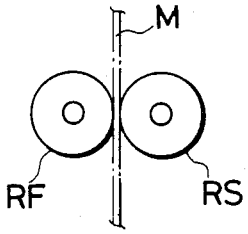
FIG. 16 is a schematic side elevation showing a pair of nonwoven fabric rolls in operation.
Figure 17:
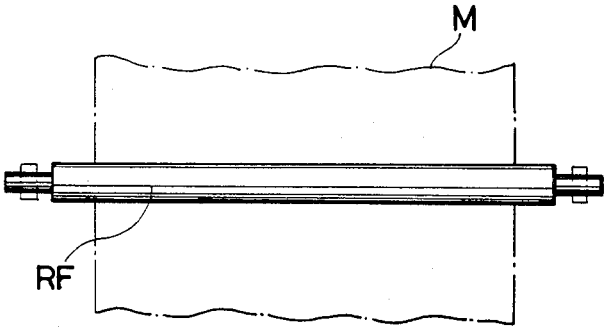
FIG. 17 is a reduced, schematic front elevation showing a textile material in engagement with the rolls.

The method according to the invention can be carried out by using two or more of the described rolls R in the following manner:

A textile material M to be treated, such as woven cloth, nonwoven fabric, knitted fabric or the like, preferably in the form of a continuously or intermittently moving web, is passed between a pair of opposed rolls RF and RS, one roll RF serving as a fluid supply roll while the other roll RS serving as a suction roll, as illustrated in FIGS. 16 and 17.

A fluid, such as water (for washing), compressed air (for blowing off moisture) or other chemical treatment medium, is forcibly introduced into the roll RF via the described fluid passageways formed internally thereof and connected via a conduit 2*c* to a pressure fluid source (not shown), and forced to flow through the layer of the nonwoven fabric elements 8 to the circumferential periphery of the roll RF. The forcible introduction of the fluid into the roll RS may be conducted continuously or intermittently.

The fluid part that has reached the circumferential periphery of the roll RF is forcibly sucked out through the interfacing portion of the material M into the suction roll RS which is connected to a known negative pressure source via the described fluid passageways. Thus, the fluid introduced into the fluid supply roll RF is forced to flow through the interfacing portion of the material M and finally transferred into the suction roll RS.

It is easily comprehensible that, in case where the fluid is water, the material M is efficiently washed by the water flowing through the interfacing portion of the material M; in case where the fluid is a chemical treatment medium, the material M is subjected to the desired chemical treatment; and in case where the fluid is compressed air, the moisture carried on the material M is forcibly blown off by the rapid stream of the air flowing through the interfacing portion of the material M.

It is obvious that the rolls RF, RS may be driven intermittently in order to hold the material M in position in standstill for predetermined seconds for better treatment.

Further, it is possible to remove the liquid from the material M impregnated with such liquied by using the roll assembly RF, RS. For this purpose, the liquid supply to the roll RF is ceased, so that only the liquid contained in the material can be sucked into the suction roll RS and then discharged out through the described fluid passageways formed internally thereof.

Figure 18:
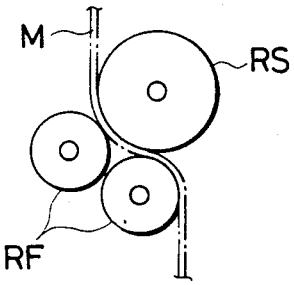
FIGS. 18 to 21 are schematic side elevations showing examples of combination and arrangement of the nonwoven fabric rolls according to the invention.
Figure 19:
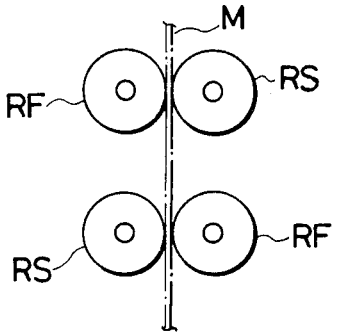

As illustrated in FIGS. 18 and 19, a combination of two fluid supply rolls RS with one suction roll RS or a combination including two or more pairs of the fluid supply rolls RF and the suction rolls RS may be utilized. If desired, any one of the rolls RF, RS may be replaced with a known rubber roll (not shown).

Figure 20:
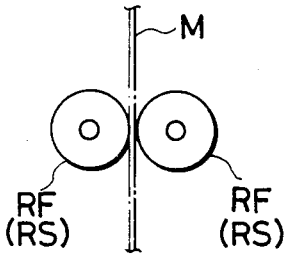

A pair of opposed fluid supply rolls RF may be used in order to promote the washing or rinsing effect as illustrated in FIG. 20. Likewise, a pair of opposed suction rolls RS may be used in order to promote the sucking-out effect as also illustrated in FIG. 20. When dewatering is conducted by use of these suction rolls RS, operating time and heat energy required in a subsequent drying stage can be considerably reduced.

Figure 21:
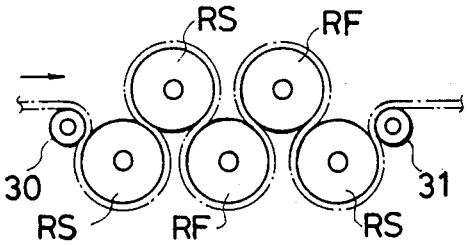

The method according to the invention can be utilized as a system for carrying out several sequential treatments in a continuous manner. For instance, as illustrated in FIG. 21, the material M, guided into the system by means of guide rollers 30, is passed between a pair of upstream suction rolls RS, as a first stage, to remove a certain chemical treatment liquid from the material M, and then it is passed between a pair of fluid supply rolls RF, disposed downstream of the aforesaid rolls RS, to wash away the remaining chemical treatment liquid by water that flows out of the peripheries of the rolls RF, and thereafter the material is fed on a downstream suction roll RS to remove the water from the material by sucking out, and finally the material M is fed out of the system via guide rolls 31 into a next stage (for example a drying stage). The chemical treatment liquid recovered at the upstream suction rolls RS may be recycled or introduced into a reservoir (not shown) for reuse. By varying combination and arrangement of the rolls RF, RS, various sequential treatment systems can be realized.

A flow rate of the fluid to be supplied into the roll RF can be easily controlled for example by means of a known valve or valves (not shown) installed in the fluid supply system which is operatively connected to the roll RF. A negative pressure to be applied to the suction roll RS can also be easily adjusted for example by controlling a known suction pump (not shown). Consequently, the flow rate of the fluid passing through the interfacing material M can be easily controlled, whereby uniform quality of treated material can be attained.

The present invention being thus described, it will be obvious that same may be varied in many ways. Such variations are not to be regarded as a departure from the spirit and scope of the invention, and all such modifications as would be obvious to one skilled in the art are intended to be included within the scope of the following claims.

I claim:

1. A combination of nonwoven fabric rolls for use in carrying out a method of treating textile material, comprising at least one fluid supply roll which includes a first cylindrical core extending coaxially of said fluid supply roll, a number of first nonwoven fabric elements mounted on said first cylindrical core in tight contact relation to one another, and first fluid passageways which are formed internally of said fluid supply roll for intercommunicating connection through first conduit means to an external forcible fluid supply source and which are open to said first nonwoven fabric elements for forcibly letting treatment fluid flow out of the circumferential periphery of said fluid supply roll, at least one suction roll opposed in cooperative relationship with said fluid supply roll, and said suction roll including a second cylindrical core extending coaxially of said suction roll, a number of second nonwoven fabric elements mounted on said second cylindrical core in tight contact relation to one another, and second fluid passageways which are formed internally of said suction roll for intercommunicating connection through second conduit means to an external negative pressure source and which are open to said second nonwoven fabric elements for forcibly sucking said treatment fluid flowing out of said circumferential periphery of said fluid supply roll.

2. The combination as defined in claim 1, wherein each of said nonwoven fabric elements is in the form of a disk with a central hole through which said cylindrical core extends.

3. The roll as defined in claim 2, wherein each of said nonwoven fabric elements in the form of said disk has a plurality of circumferentially spaced apertures formed therein at predetermined locations, and said apertures jointly constitute a plurality of axially extending bores which form a part of said fluid passageways when said nonwoven fabric elements are pressed together into tight contact relation to one another.

4. The roll as defined in claim 3, which further comprises an end plate fixedly mounted on one end of said cylindrical core, said end plate having a plurality of circumferentially spaced apertures formed therein, a stationary disk supported on said one end of said cylindrical core via bearing means so as to be free from rotation of said roll, in relatively slidable relation to an outer wall surface of said end plate, a recess formed in an inward wall of said stationary disk, said plurality of circumferentially spaced apertures of said end plate being opposed to end openings of said plurality of axially extending bores for communication therewith, and said recess being arranged so that at least two of said plurality of circumferentially spaced apertures of said end plate come into and then out of communication with said recess one after another in endless manner when said roll rotates.

5. The combination as defined in claim 1, wherein each of said nonwoven fabric elements is in the form of a rectangular sheet whose cross section extends substantially radially from said cylindrical core.

6. The combination as defined in claim 5, wherein a predetermined number of said nonwoven fabric elements in the form of rectangular sheets are fitted into a mounting base to constitute a unit, and a plural number of said units are mounted on said cylindrical core in side-by-side relationship.

7. The roll as defined in claim 1, wherein a plural number of foreign elements made of non-liquid-absorbing sheet material are used in combination with said nonwoven fabric elements.

8. The roll as defined in claim 7, wherein a plurality of spaced annular grooves are formed in circumferential periphery of a cylindrical body consisting of said nonwoven fabric elements and said foreign elements which are pressed together into tightly contact relation to one another.

9. The roll as defined in claim 1, wherein said cylindrical core is a tubular member having an axially extending internal hollow space and a number of perforated holes formed in its cylindrical wall in communication with said internal hollow space, and said internal hollow space and said perforated holes form a part of said fluid passageways.

10. The roll as defined in claim 1 wherein a plural number of elongated spacers are interposed between said cylindrical core and said nonwoven fabric elements to provide a plural number of axially extending channel-shaped spaces therebetween which form a part of said fluid passageways.

* * * * *